United States Patent [19]

Sorber

[11] Patent Number: 4,604,826

[45] Date of Patent: Aug. 12, 1986

[54] AUTOMATIC SLIDING DOOR OPERATOR

[75] Inventor: Robert Sorber, Charlotte, N.C.

[73] Assignee: Keane Monroe Corporation, Monroe, N.C.

[21] Appl. No.: 666,507

[22] Filed: Oct. 30, 1984

[51] Int. Cl.[4] ..... E05F 15/20

[52] U.S. Cl. ..... 49/31; 49/25; 49/30; 49/370

[58] Field of Search ..... 49/31, 30, 25, 370

[56] References Cited

U.S. PATENT DOCUMENTS

| | | | |
|---|---|---|---|
| 3,626,637 | 12/1971 | Rudicel | 49/25 |
| 3,742,434 | 6/1973 | Leyde et al. | 49/25 |
| 4,009,476 | 2/1977 | Lutz | 49/31 |
| 4,272,921 | 6/1981 | Jorgensen | 49/31 |
| 4,338,553 | 7/1982 | Scott, Jr. | 49/31 |

*Primary Examiner*—Victor N. Sakran

*Attorney, Agent, or Firm*—Shefte, Pinckney & Sawyer

[57] ABSTRACT

A solid state integrated regulating circuitry for incorporation in the conventional control circuitry of automatic sliding door systems includes timing and processing circuits operative through plural inverters to deliver enabling and disenabling electrical signals to the control circuitry when the elapsed time between cycles of door opening and closing actuations are greater or less than a predetermined time respectively either to prematurely terminate or to have no altering effect upon door opening actuation, thereby to open the doors to a reduced width during low traffic conditions and to open the doors to a full width during high traffic conditions.

5 Claims, 2 Drawing Figures

AUTOMATIC SLIDING DOOR OPERATOR

BACKGROUND OF THE INVENTION

Automatically-operated sliding doors of varying types are well known and in widespread commercial use. Typically, the operation of such doors is electromechanically controlled by actuation from a weight-sensitive mat, a photoelectric eye, or similar devices for sensing the approach or presence of a person or object at the door requiring its opening.

Such automatic sliding doors are typically installed where a need exists to accommodate high volumes of traffic, e.g., supermarkets, retail stores, banks, airports, hospitals, etc. However, even in such uses, traffic volume ordinarily varies widely over time. As will be recognized, when traffic volume is low, say where opening actuation occurs only once every 20–30 seconds or less often, only one person typically is passing through the door during each opening actuation. Under such circumstances, the doors need not open fully as under high traffic conditions when a number of persons may pass through the doors together or in succession. However, all conventional automatic sliding doors have actuating and control arrangements which are incapable of opening the doors to differing widths under differing traffic conditions, but instead are set to always open whenever actuated to the fullest extent necessary under heavy traffic conditions, regardless of the actual traffic volume.

It will be appreciated that each opening actuation of such doors results in the loss of heated or cooled air. Thus, the conventional set-up of such doors to open fully even under low traffic conditions causes significantly greater such losses over time than would occur if the doors were opened each time only to the extent necessary in relation to the prevailing traffic conditions.

SUMMARY OF THE INVENTION

In contrast, the present invention provides an improvement in automatic sliding door control systems for rendering them capable of opening such doors to varying widths in relation to the prevailing traffic conditions.

Basically, the automatic door control systems to which the improvement of the present invention relates comprise a frame in which the door is slidably supported for opening and closing movement, a motor or similar arrangement for driving the opening and closing movements of the door, and a control arrangement for controlling the actuation and de-actuation of the motor and operative upon each such actuation cycle to cause the door to be moved to provide an opening of a predetermined width. According to the present invention, a regulating arrangement is operatively associated with the motor control arrangement to regulate the width to which the door is opened in relation to the frequency of the actuation of the motor. The regulating arrangement is provided with a timer for determining at any given time whether or not the elapsed time since the last previous cycle of door opening and closing actuation of the motor is greater or less than a predetermined time value. The timer is operative on the control arrangement upon each door opening actuation of the motor for stopping movement of the door beyond a reduced opening of less than the predetermined width when the elapsed time is greater than the predetermined time value and for permitting movement of the door fully to the opening of the predetermined width when the elapsed time is less than the predetermined time value.

In the preferred embodiment, the motor control arrangement is electrically operated and the regulating arrangement includes logic circuitry electrically connected with the control arrangement to receive an electrical input signal therefrom upon each door opening actuation of the motor and to provide different motor enabling and motor disenabling return signals to the control arrangement respectively when the elapsed time is less than and greater than the predetermined time value. The logic circuitry is operatively associated with the motor control arrangement to cause it to have no altering effect upon full door opening actuation of the motor in response to the enabling signal but to terminate door opening actuation of the motor prematurely in response to the disenabling signal for opening of the door only to the reduced width.

The logic circuitry includes a timing circuit arranged to store transiently electrical energy from each electrical input signal and to controllably dissipate the stored electrical energy over the predetermined time period, such that the timing circuit produces a motor disenabling return signal while the stored electrical energy is effectively retained to be indicative that the elapsed time is less than the predetermined time and to produce a motor enabling return signal when the stored electrical energy has been effectively dissipated to be indicative that the elapsed time exceeds the predetermined time. The logic circuitry further includes another circuit parallel to the timing circuit arranged to produce the enabling return signal in response to each electrical input signal from the motor control arrangement and processing circuitry electrically connected with each of the timing and parallel circuits to receive their respective outputs and to control in a predetermined manner the return signal to the motor control means in relation thereto. The processing circuitry includes appropriate diodes or similar devices for blocking the electrical flow of the enabling return and for permitting electrical flow of the disenabling return signal of each of the timing and parallel circuits. The processing circuitry further includes a circuit bypassing the blocking devices and having resistors for controllably permitting electrical flow of the enabling signal of the parallel circuit. An inverter is provided in the processing circuitry for receiving the disenabling return signal from the timing circuit and changing it to the enabling return signal and alternatively for receiving the enabling return signal from the bypass circuit and changing it to the disenabling return signal. The inverter is electrically connected with the control arrangement to transmit each inverted signal thereto as the return signal to the input signal of the motor control arrangement.

The resistors have a predetermined electrical resistance to electrical flow of the enabling return signal of the parallel circuit to produce a predetermined time delay for flow of such enabling signal through the resistors and the inverter and return flow of the inverted disenabling signal to the motor control arrangement thereby to determine the width of the reduced door opening to which the motor will open the door before the motor control arrangement receives the inverted disenabling signal. Preferably, a variable resistor is provided for permitting selective adjustment of the time delay and thereby of the width of the reduced door opening.

DESCRIPTION OF THE PREFERRED EMBODIMENT

Figure 1:
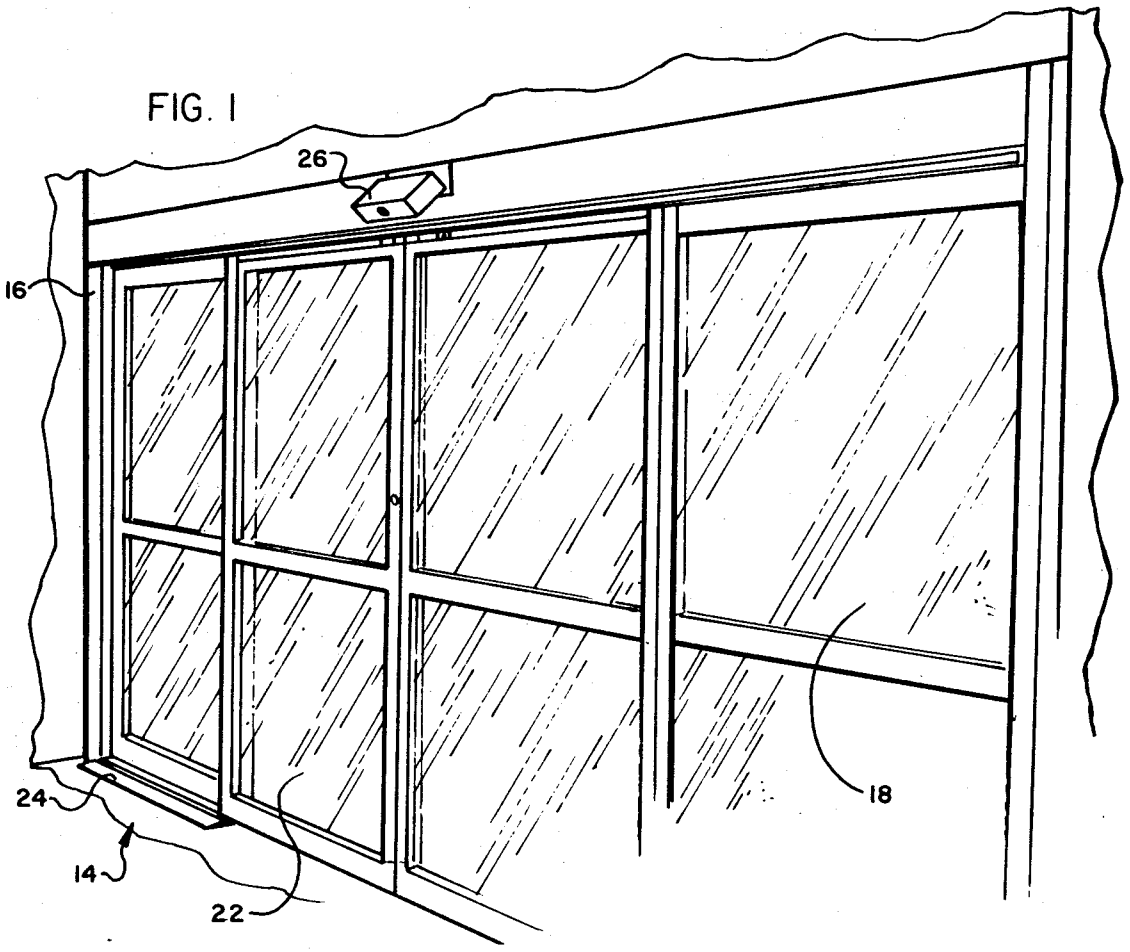
FIG. 1 is a perspective view of a conventional sliding door in which the improved door control system of the present invention is preferably embodied.
Figure 2:
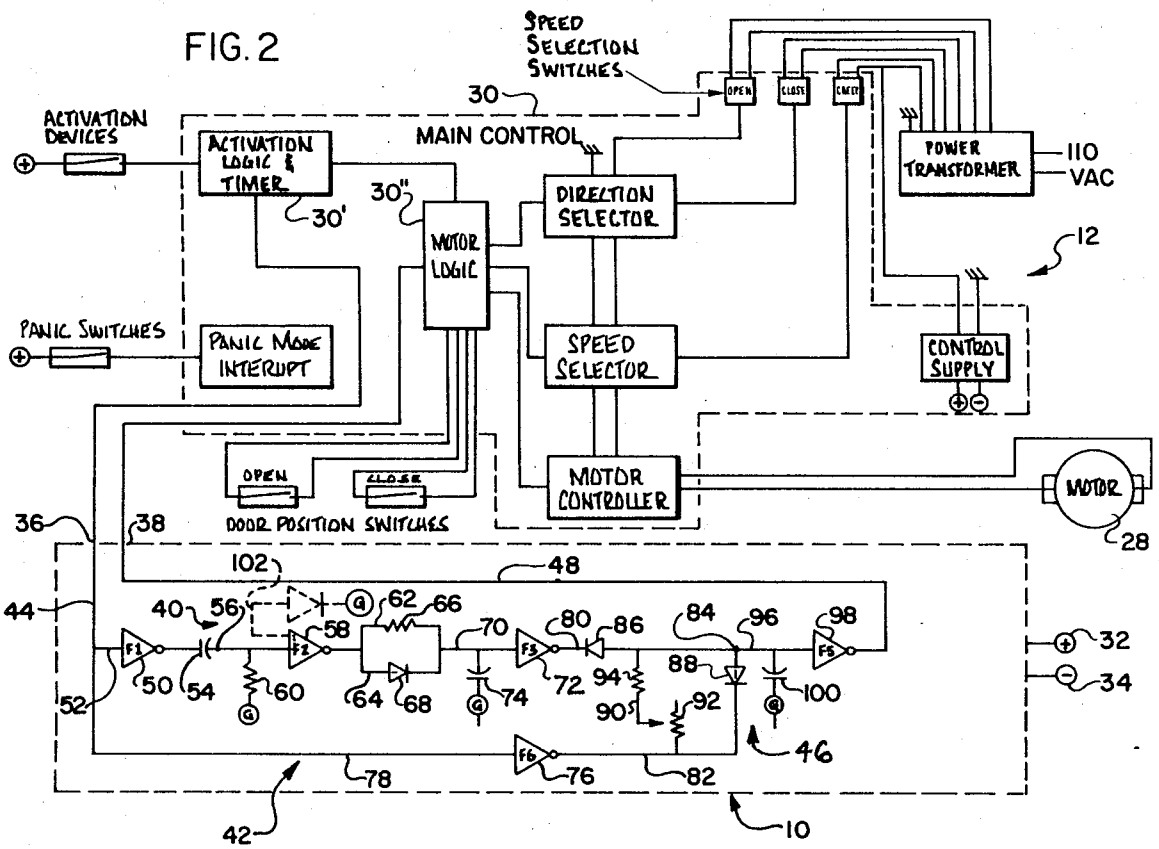
FIG. 2 is a schematic diagram of the preferred embodiment of the improved regulating circuitry of the present invention in association with the circuitry of a conventional automatic sliding door control system.

Referring now to the accompanying drawings, the regulating circuitry of the present invention, generally indicated in FIG. 2 at 10, is illustrated and described herein n its preferred embodiment in conjunction with a conventional automatic electro-mechanical door control arrangement, generally indicated at 12, for controlling the opening and closing actuation of an associated sliding door structure, generally indicated at 14.

The sliding door structure 14 is of the conventional type having a door frame 16 constructed of two laterally spaced upright sidelite panels 18 above and between which extends a header housing 20. Two upright doors 22 are supported slidably for opposite closing and opening movements respectively toward and away from one another by rollers (not shown) disposed on a suitable trackway (not shown) in the header housing 20 above the doors 22 and sidelites 18 with a supplementary stabilizing track 24 provided at the bottom of the sidelite panels 18. Of course, it will be understood that the present regulating circuitry 10 is equally applicable to be embodied in association with door structures having only one door as well as to substantially any other conventional automatically operated sliding door structure. For example, the present regulating circuitry 10 is preferably incorporated with any of the "Series 7000 Automatic Sliding Entrances" manufactured and sold by Keane Monroe Corporation of Monroe, N.C.

The electro-mechanical control arrangement 12 and the regulating circuitry 10 are housed within the header 20. The electro-mechanical control arrangement 12 may also be of conventional type including a suitable actuation device or devices, indicated generally at 26 in FIG. 2, such as weight sensitive entrance mats, photoelectric eyes, or similar detectors provided at one or both sides of the door structure 14 for detecting the approach or presence of a person or object requiring door opening, in operative combination with an electro-mechanical motorized control system to actuate a cycle of opening and closing movement of the doors 22 upon each operation of the actuation devices 26. With reference to FIG. 2, the electro-mechanical control arrangement 12 is shown only schematically in block diagram as it is preferably of the conventional type of the aforementioned Keane Monroe Corporation Series 7000 Automatic Sliding Entrances. Basically, the control arrangement 12 includes a reversible electric motor 28 connected with the doors 22 by an appropriate system of chains and cables trained about suitable sprockets and pulleys to transmit the driving output of the motor 28 to the doors 22 to cause them to slide toward and away from one another in the guide trackways. An operating logic circuit, indicated at 30, powered by a source of low voltage alternating electrical current, supplied through the power transformer of the control arrangement 12, provides electronic logic for supplying operating electrical current to the activation devices 26, for monitoring the actuation thereof, for supplying operating electrical current to the motor 28 for controlling its actuation and de-actuation response to the activation devices 26, for controlling the direction and speed of operation of the motor 28, and for controlling the time period over which the doors 22 remain open during any opening and closing cycle, all in conventional manner.

The regulating circuitry 10 is constructed as a separate circuitry unit adapted to be readily connected with the conventional control circuitry of the control arrangement 12 without requiring any change in such control circuitry. However, those persons skilled in the art will readily recognize that the regulating circuitry 10 and the control circuitry of the control arrangement 12 may be constructed together as desired as a single unit. The regulating circuitry unit 10 is provided with positive and negative power terminals 32,34 by which it is connected to the main circuitry of the control arrangement 12 to be supplied therefrom with 12 volt direct current power with positive ground. Thus, as used herein, the term "negative signal" will be understood by those persons skilled in the art to mean an electrical signal of negative 12 volts direct current and the term "positive signal" will be understood to mean an opposite electrical signal of 0 volts direct current. An input terminal 36 of the regulating circuitry unit 10 is provided for connection with the activation logic and timer circuitry 30' of the logic circuitry 30, and a corresponding output terminal 38 of the regulating circuitry unit 10 is provided for connection with the motor logic circuitry 30'' of the logic circuitry 30. Basically, the regulating circuitry 10 includes a timing circuit, indicated at 40, and another circuit, indicated at 42, connected in parallel to an input line 44 from the input terminal 36, and a processing circuit 46 which processes the output signals from the timing and parallel circuits 40,42 and transmits an output return signal through an output line 48 to the output terminal 38 for return to the motor logic circuitry 30''.

The timing circuit 40 includes an inverter 50 the input terminal of which is electrically connected by a line 52 to the input line 44 and the output terminal of which is electrically connected to one terminal of a 0.1 microfarad capacitor 54. The other terminal of the capacitor 54 is electrically connected by a line 56 with the input terminal of another inverter 58, with a grounded 2,700,000 ohm resistor 60 connected to the line 56. Branched lines 62,64 are electrically connected to the output terminal of the inverter 58, another 2,700,000 ohm resistor 66 being provided in the line 62 and a diode 68 being arranged in the line 64 to permit positive signal current flow and block negative signal current flow from the inverter 58. The branched lines 62,64 rejoin in a single line 70 which is connected to the input terminal of a third inverter 72. One terminal of a grounded 10 microfarad capacitor 74 is connected to the line 70 in advance of the inverter 72. The parallel circuit 42 includes another inverter 76 the input terminal of which is connected by a line 78 to the input line 44.

The processing circuit 46 includes lines 80,82 which are electrically connected respectively to the output terminals of the inverters 72 and 76 and are joined electrically at 84. Diodes 86,88 are respectively arranged in the lines 80,82 to block positive signal current flow from the output terminals of the inverters 72,76. A bypass circuit 90, including a 1,000,000 ohm variable resistor 92 and a 56,000 ohm resistor 94 in series with one another, extends between the line 82 in advance of its diode 88 and the line 80 following its diode 86. A final inverter circuit line 96 including another inverter 98 extends from the point 84 joining the lines 80,82 to the output line 48. a grounded 10 microfarad capacitor 100 is connected to the line 96 in advance of the inverter 98.

Each of the inverters is preferably a standard Hex Schmitt Trigger Inverter Integrated Circuit No. MC 14584, of the conventional type available from various electronics manufacturers. Of course, as those persons skilled in the art will recognize, non-Schmitt trigger inverters as well as nand gates, nor gates or other gates or components such as operational amplifiers, transistors or vacuum tubes could be used in place of such Schmitt trigger inverters.

In operation, the input terminal 36 of the regulating circuitry 10 is operatively connected with the actuating logic and timer circuitry 30' of the logic circuitry 30 to receive therefrom a positive electrical signal whenever the doors 22 are closed or in the process of closing, and a negative electrical signal whenever the doors 22 are open or in the process of opening. The motor logic circuitry 30" of the logic circuitry 30 is arranged in association with the activation logic and timer circuitry 30' to actuate the motor 28 in one direction for door closing when a positive electrical signal is received from the activation logic and timer circuitry 30' and to actuate the motor 28 in the opposite direction for door opening when a negative electrical signal is received therefrom. The output terminal 38 of the regulating circuity 10 is operatively connected with the motor logic circuitry 30" to transmit thereto either a positive motor enabling or negative motor disenabling electrical output signal from the regulating circuitry 10 respectively for permitting or stopping actuation of the motor 28.

For purposes of describing the operation of the present invention, it is assumed initially that the doors 22 are closed and have not been opened for greater than a predetermined time chosen as distinguishing light and heavy traffic conditions. In such state, a positive electrical signal is supplied to the input terminal 36 from the activation logic and timer circuitry 30' and is transmitted along input line 44 to each of the timing and parallel circuits 40,42. In the timing circuit 40, the positive electrical signal is inverted through the inverter 50 to deliver a negative output signal to the capacitor 54. As will be understood, this negative signal to the capacitor 54 will have prevailed for some time since the doors have been closed for some time, whereby the output terminal of the capacitor 54 has become positively charged relative to the input terminal under the effect of the positively grounded resistor 60. The capacitor 54 therefore blocks the transmission therethrough of the negative signal from the inverter 50 and the positive electrical signal from the positively grounded resistor 60 is transmitted through the line 56 to the inverter 58. The inverter 58 inverts the positive input signal to a negative output signal which is transmitted through the line 62 and resistor 66 to the input terminal of the inverter 72, which inverts the negative signal to a positive output signal. At the same time, the positive input signal from the input line 44 is transmitted through the line 78 to the inverter 76 which inverts the signal to a negative output signal. As will be understood, the diode 86 acts to block the positive output signal from the inverter 72, while the diode 88 permits the negative output signal of the inverter 76 to flow therethrough to the line 96. This negative signal through the line 96 is inverted to a positive output signal by the inverter 98, and this positive motor enabling signal is transmitted through the output line 48 as a return signal to the motor logic circuitry 30" of the logic circuitry 30. The logic circuitry 30 and the regulating circuitry 10 remain in this condition as described until activation of one of the activation devices 26 occurs.

Upon activation of one of the activation devices 26, the activation logic and timer circuitry 30' delivers a negative electrical input signal to the input line 44 of the regulating circuitry 10. In the timing circuit 40, the negative input signal is inverted by the inverter 50 to a positive output signal which is delivered to the input terminal of the capacitor 54. Since prior to door actuation the output terminal of the capacitor 54 had been positively charged with respect to the negative signal on its input terminal, the capacitor 54 now attempts to achieve a more positive charge on its output terminal than the positive charge now delivered to its input terminal, creating a positive pulse which is dissipated through an internal protection diode 102 inside the inverter 58. The negative output condition of the inverter 58 and the negative input and positive output conditions of the inverter 72 therefore remain unchanged from their original starting conditions described above. However, the output and input terminal of the capacitor 54 now have approximately the same potential, i.e. 0 volts, which enables the timing circuit 40 to reset at the start of the next door opening cycle. The negative input signal from the activation logic and timer circuitry 30' is transmitted at the same time through the line 78 to the inverter 76 which inverts it to a positive output signal. The diodes 86,88 in the lines 80,82 both act to block the positive output signals from the inverters 72,76. Thus, the positive output signal from the inverter 76 flows through the variable resistor 92 and the resistor 94 of the bypass circuit 90 to the line 80 following the diode 86. This positive signal continues through the line 80 and through the line 96 and is inverted through the inverter 98 to produce a negative motor disenabling output signal. This negative output signal travels through the ouput line 48 and is returned to the motor logic circuitry 30", wherein this negative return signal acts to immediately stop the opening actuation of the motor 28 and thereby to stop the opening of the doors 22. The electrical resistance in the resistors 92,94 in the bypass circuit 90 are selected to delay the flow of the positive output signal from the inverter 76 to the line 80 to permit the doors 22 to open to a reduced width less than the aforementioned predetermined full opening width normally determined by the motor logic circuitry 30", before the negative return signal stops the motor 28.

Following a time period predetermined by the motor logic circuitry 30', the motor 28 is actuated in the reverse direction to cause the doors 22 to return to a closed condition. Thereupon, the activation logic and timer circuitry 30' delivers a positive input signal to the input terminal 36 and input line 44 of the regulating circuitry 10. In the timing circuit 40, this positive input signal is inverted to a negative signal through the inverter 50. Since both terminals of the capacitor 54 were previously positive as described above, this negative signal briefly continues as a transient negative signal through the capacitor 54 and is again inverted through the inverter 58 to a transient positive output signal. This positive output signal travels through the branch line 64 and its diode 68 and operates to positively charge the capacitor 74. The positive signal is also applied to the inverter 72 and is inverted to a negative output signal. Similarly, the positive input signal is transmitted through the line 78 to the inverter 76 and is inverted therethrough to a negative output signal. The negative output signals of the inverters 72,76 both travel through the diodes 86,88 in lines 80,82 to the line 96 and are inverted through the inverter 98 to a positive motor enabling output signal which is returned through the output line 48 to the motor logic circuitry 30''. As will be understood, this positive signal has no effect on the motor logic circuitry 30'' which is therefore permitted in its ordinary manner to continue actuation of the motor 28 to fully close the doors 22.

After a short period of time determined by the values of the capacitor 54 and resistor 60, the output terminal of the capacitor 54 will again become positively charged under the effect of the grounded resistor 60 in response to the negative signal being applied to the input terminal of the capacitor 54, thereby blocking further transmission of the negative signal from the inverter 50 through the capacitor 54. At this time, the input to the inverter 58 becomes positive again and the output therefrom again becomes negative.

The positive charge applied to the capacitor 74 is slowly dissipated through the resistor 66 in the branched line 62, the resistance value of the resistor 66 being selectively chosen to control the rate and time period for dissipation of the positive charge on the capacitor 74. As will be understood, the inverter 72, being a Schmitt trigger inverter, operates as a hysteresis device and reacts to input signal changes of a predetermined amount beyond the mid-point voltage between positive 0 volts and negative 12 volts to produce a changed output signal. For example, the inverter 72 may typically require a signal voltage change on the order of approximately fifty-five percent to produce a changed output signal. So long as the capacitor 74 remains positively charged with respect to the inverter 72 (i.e. the capacitor 74 retains more than approximately 45% of its positive charge), an effective positive signal will prevail on the input of the inverter 72 to produce a negative output thereof which travels through the lines 80,96 and is inverted through the inverter 98 to provide a positive motor enabling return signal to the motor logic circuitry 30''. Thus, during the time period required for effective dissipation of the positive charge on the capacitor 74 with respect to the inverter 72, the regulating circuitry is prevented from delivering a negative return signal to the motor logic circuitry 30''. Accordingly, if the activation devices 26 are again activated to cause opening of the doors 22 within the time period required for such dissipation of the positive charge on the capacitor 74 following any given cycle of opening and closing actuation of the doors 22, the regulating circuitry 10 will deliver a positive return signal to the motor logic circuitry 30'' as a result of the positive signal applied to the input of the inverter 72 by the charged capacitor 74, whereby the regulating circuitry 10 has no altering effect on the logic circuitry 30 and the logic circuitry 30 accordingly operates to cause the doors 22 to be opened to their full predetermined width. However, when an activation device 26 is actuated to cause opening of the doors 22 following the expiration of the time period required for the positive charge on the capacitor 74 to be effectively dissipated through the resistor 66 without any subsequent cycle of door opening and closing actuation having occurred, an effective negative input signal will prevail on the inverter 72 and the regulating circuitry 10 will operate in the same manner as first above-described to produce a motor disenabling negative output return signal to the motor logic circuitry 30'' to terminate prematurely door opening actuation of the motor 28.

As will thus be understood, the dissipation time period for which the resistor 66 is selected is chosen according to the present invention to differentiate low traffic and high traffic conditions according to the frequency of door opening and closing actuation cycles. Thus, whenever the interval between successive door opening and closing cycles exceeds the time period required for the positive charge on the capacitor 74 to be effectively dissipated with respect to the inverter 72, the regulating circuitry 10 will operate to deliver a negative pulse to the motor logic circuitry 30'' in the manner first described above to cause the doors 22 to be opened only to a reduced width less than the predetermined width to which the logic circuitry 30 would normally open the doors 22. On the other hand, when the interval between successive cycles of door opening and closing actuation is less than such dissipation time period, the regulating circuitry 10 will have no effect on the ordinary operation of the logic circuitry 30 so that the logic circuitry 30 operates in its ordinary manner to open the doors 22 to their full predetermined width. According to the preferred embodiment of the present invention, the resistor 66 is selected to effectively dissipate the positive charge on the capacitor 74 in a 22 second time period, thereby establishing a minimum 22 second interval between cycles of door opening and closing actuations as differentiating between low and high traffic conditions. Of course, those persons skilled in the art will readily understand that the regulating circuitry 10 may be set up to establish substantially any such predetermined dissipation time period. Additionally, those persons skilled in the art will recognize that the provision in the bypass circuitry 90 of the variable resistor 92 facilitates the selective adjustment of the electrical resistivity in the bypass circuit 90 to permit corresponding adjustment of the reduced widthwise opening to which the doors 22 are opened under low traffic conditions.

Those persons skilled in the art will recognize the significant advantages of the present invention in enabling users of automatic sliding doors to best reduce the losses of heated or cooled air therethrough during cycles of opening and closing actuation of the doors 22. A study of the traffic patterns in any given environment in which such sliding door systems are used will reveal the ordinary frequency of actuation during low traffic periods. In turn, the regulating circuitry 10 of the present invention can be selectively set up with a comparable time period for positive charge dissipation from the capacitor 74 to selectively differentiate in the widthwise opening of the doors between low and high traffic conditions. In this manner, the quantity of heated and cooled air lost over time will be significantly reduced, with corresponding significant savings in heating and cooling energy expenses and corresponding significant increases in heating and cooling energy efficiency.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. In an automatic door control system of the type comprising a frame in which a door is slidably supported for opening and closing movement, driving means for driving said opening and closing movements of said doors, and control means for controlling actuation and de-actuation of said driving means and operative upon each said actuation to cause said door to be moved to provide an opening of a predetermined width, the improvement comprising means operatively associated with said control means for regulating the width of said door opening in relation to the frequency of actuation of said driving means, said regulating means including timing means for determining at any given time whether or not the elapsed time since the last previous cycle of door opening and closing actuation of said driving means is greater or less than a predetermined time value, said timing means being operative on said control means upon each door opening actuation of said driving means for stopping movement of said door beyond a reduced opening of less than said predetermined width when said elapsed time is greater than said predetermined time value and for permitting movement of said door fully to said opening of said predetermined width when said elapsed time is less than said predetermined time value, said regulating means comprising logic circuit means electrically connected with said control means to receive an electrical input signal therefrom upon each said door opening actuation of said driving means, said logic circuit means being arranged to provide different return signals to said control means respectively when said elapsed time is less than and greater than said predetermined time value, said logic circuit means being operatively associated with said control means to cause it to terminate prematurely door opening actuation of said driving means in response to a disenabling one of the return signals representing that said elapsed time exceeds said predetermined time value and to have no altering effect upon door opening actuation of said driving means in response to an enabling one of said return signals representing that said elapsed time is less than said predetermined time value.

2. The improvement in an automatic door control system according to claim 1 and characterized further in that said regulating means includes means for selectively varying the width of said reduced opening.

3. The improvement in an automatic door control system according to claim 1 and characterized further in that said logic circuit means includes a timing circuit arranged to store transiently electrical energy from each said electrical input signal, said timing circuit having means for controllably dissipating said stored electrical energy over said predetermined time, said logic circuit means being arranged for transmitting to said control means said enabling return signal while said timing circuit effectively retains said stored electrical energy and said disenabling return signal when said timing circuit has effectively dissipated said stored electrical energy.

4. The improvement in an automatic door control system according to claim 3 and characterized further in that said timing circuit is arranged to produce said enabling return signal when said elapsed time exceeds said predetermined time and to produce said disenabling return signal when said elapsed time is less than said predetermined time, and characterized further in that said logic circuit means comprises another circuit parallel to said timing circuit arranged to produce said enabling return signal in response to each said electrical input signal from said control means, and processing circuit means electrically connected with each of said timing and parallel circuits to receive their respective outputs, said processing circuit means including means for blocking electrical flow of said enabling return signal and for permitting electrical flow of said disenabling return signal of each of said timing and parallel circuits, a circuit bypassing said blocking and permitting means and having resistive means for permitting electrical flow of said other signal of said parallel circuit, and inverter means for receiving said disenabling return signal from said timing circuit and changing it to said enabling return signal and for receiving said enabling return signal from said bypass circuit and changing it to said disenabling return signal, said inverter means being electrically connected with said control means for transmitting each inverted signal thereto as the return signal to the input signal of said control means, said resistive means having a predetermined electrical resistance to electrical flow of said enabling signal of said parallel circuit to produce a predetermined time delay for flow of said enabling signal of said parallel circuit through said resistive means and said inverter means and return flow of the inverted said disenabling signal therefrom to said control means to determine the width of the reduced door opening to which said driving means will open said door before said control means receives the inverted said disenabling signal.

5. The improvement in an automatic door control system according to claim 4 and characterized further in that said resistive means includes a variable resistor for permitting selective adjustment of the width of the reduced door opening.

* * * * *